US005349424A

United States Patent [19]

Dalal et al.

[11] Patent Number: 5,349,424

[45] Date of Patent: Sep. 20, 1994

[54] THICK WALLED HEATED BELT FUSER

[75] Inventors: Edul N. Dalal, Webster; Robert M. Jacobs, Ontario, both of N.Y.

[73] Assignee: Xerox Corporation, Stamford, Conn.

[21] Appl. No.: 140,926

[22] Filed: Oct. 25, 1993

[51] Int. Cl.[5] ..... G03G 15/20

[52] U.S. Cl. ..... 355/285; 355/290; 219/216

[58] Field of Search ..... 355/285, 289, 290, 295; 219/216, 388

[56] References Cited

U.S. PATENT DOCUMENTS

| | | | |
|---|---|---|---|
| 4,242,566 | 12/1980 | Scribner | 219/216 |
| 4,243,869 | 1/1981 | Scribner | 219/216 |
| 4,372,246 | 2/1983 | Azar et al. | 118/60 |
| 4,565,439 | 1/1986 | Reynolds et al. | 355/3 FU |
| 4,582,416 | 4/1986 | Karz et al. | 355/3 FU |
| 4,711,549 | 12/1987 | Roodbeen | 219/216 X |
| 4,922,304 | 5/1990 | Gilbert et al. | 355/282 |
| 5,115,278 | 5/1992 | Maruta et al. | 355/285 |
| 5,157,447 | 10/1992 | Farnand et al. | 355/290 |
| 5,157,466 | 10/1992 | Kusaka | 355/285 |
| 5,235,395 | 10/1993 | Ishiwata | 355/285 |
| 5,278,618 | 1/1994 | Mitani et al. | 355/285 |

*Primary Examiner*—R. L. Moses

*Attorney, Agent, or Firm*—Kevin R. Kepner

[57] ABSTRACT

A heated thick walled belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the heat transfer. The second span of the belt forms an extended fusing nip with a pressure roll. The extended nip provides a greater dwell time for a sheet in the nip while allowing the fuser to operate at a greater speed. External heating enables a thick profile of the belt, which in turn allows the belt to be reinforced so as to operate at greater fusing pressures without degradation of the image. The thick profile and external heating of the belt also provides a much more robust design than conventional thin walled belt fusing systems.

18 Claims, 4 Drawing Sheets

THICK WALLED HEATED BELT FUSER

This invention relates generally to a fuser mechanism for an electrophotographic printing machine, and more particularly concerns a thick walled belt fusing system for use particularly in full color electrophotographic printing machines.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. Particularly with respect to multicolor images the finish gloss of the toner image is also a concern.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon.

Roll fusers have the limitation of a rather small nip contact area and with the advent of full color printing machines this small fusing nip is one of the speed limiting factors. To properly fuse a full color image a minimum dwell time must be observed. A slightly longer nip can be created by increasing the thickness of the elastomer coating on the roll but this approach can lead to premature roll failure due to a high temperature drop and high stresses in the coating.

Some roll fusers are externally heated but there is an efficiency loss again due to the small contact area of the heating nip. This results in a need for either multiple heating rolls and/or very large temperature gradients between the heater roll and fuser roll which can cause premature failures due to the excess heat.

Thin walled fusing belts have also been utilized to create a longer nip, however, these type belts are heated internally and must be highly conductive across the thickness in order to avoid large temperature gradients and high core temperatures. These belts tend to be very fragile due to the requirements of high conductivity and flexibility. Thus, the belt fuser must be operated at rather low pressures to minimize strain on the belts.

It is desirable therefore to have a belt fuser which can operate at high pressures and have an extended nip so as to increase the fusing speed for multi color images. It is also desirable that such a fuser be externally heated from a single heat source which does not require a large temperature gradient to effectively heat the fuser belt.

The following disclosures may be relevant to various aspects of the present invention:

U.S. Pat. No. 4,922,304, Gilbert et al., May 1, 1990
U.S. Pat. No. 4,582,416, Karz et al., Apr. 15, 1986
U.S. Pat. No. 4,565,439, Reynolds, Jan. 21, 1986
U.S. Pat. No. 4,372,246, Azar et al., Feb. 8, 1983

The relevant portions of the foregoing disclosures may be briefly summarized as follows:

U.S. Pat. No. 4,922,304 describes a ridged belt that acts as the fuser pressure member to force an unfused copy sheet against a heated roll or drum.

U.S. Pat. No. 4,582,416 discloses a thin walled fuser belt that operates with a pressure roll and a stationary mandrel to form a nip through which the belt and copy sheet pass simultaneously to fuse the image to the sheet.

U.S. Pat. No. 4,565,439 describes a thin walled fusing belt which uses a mandrel to form a fusing nip and further provides for a belt tracking and mandrel skewing device to maintain proper belt tracking.

U.S. Pat. No. 4,372,246 discloses an externally heated fuser roll which is made of a base, a relatively thick foam layer of a fluoroelastomer and a relatively thin layer of silicone elastomer on the foam layer.

In accordance with one aspect of the present invention, there is provided a heat and pressure fuser apparatus. The apparatus comprises a rotatably supported fuser belt and a pressure member adjacent a first portion of said belt wherein the first portion of said belt contacts said pressure member to form an extended nip therewith. A heat source, adjacent a second portion of said belt is also provided.

Pursuant to another aspect of the present invention, there is provided an electrophotographic printing machine in which a toner image is heat and pressure fused to a substrate by a fuser member. The improvement comprises a rotatably supported fuser belt and a pressure member adjacent a first portion of said belt wherein the first portion of said belt contacts said pressure member to form an extended nip therewith. A heat source, adjacent a second portion of said belt is also provided.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
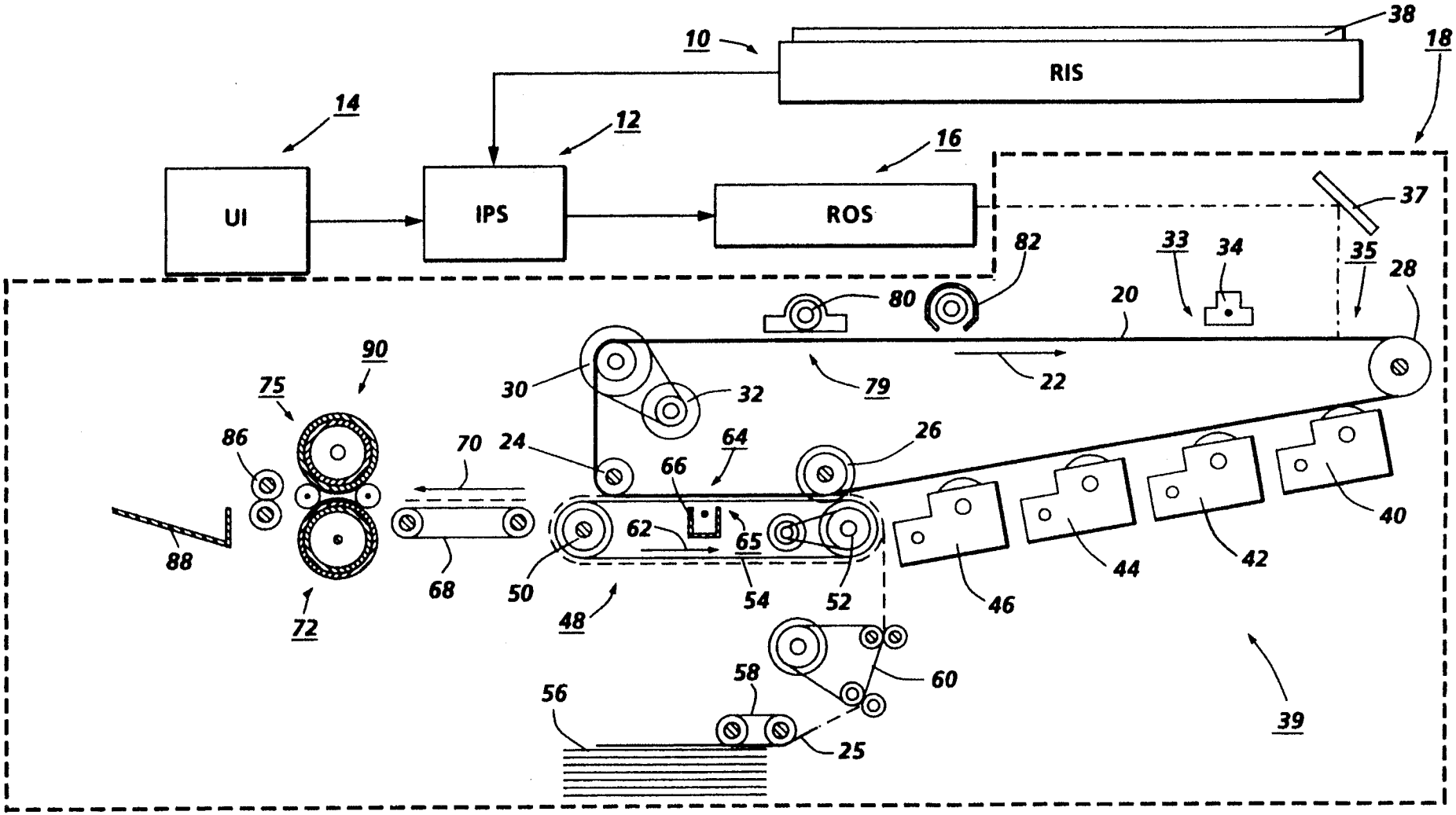
FIG. 4 is a schematic view of a full color electrophotographic printing machine incorporating the fuser assembly of FIG. 1.

For a general understanding of the features of the present invention, reference is made to the drawings. In the drawings, like references have been used throughout to designate identical elements. FIG. 4 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 4, during operation of the printing system, a multi-color original document 38 is positioned on a raster input scanner (RIS) indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 4, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned there at. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12. A fourth latent image can also be recorded to be developed with black toner.

Figure 3:
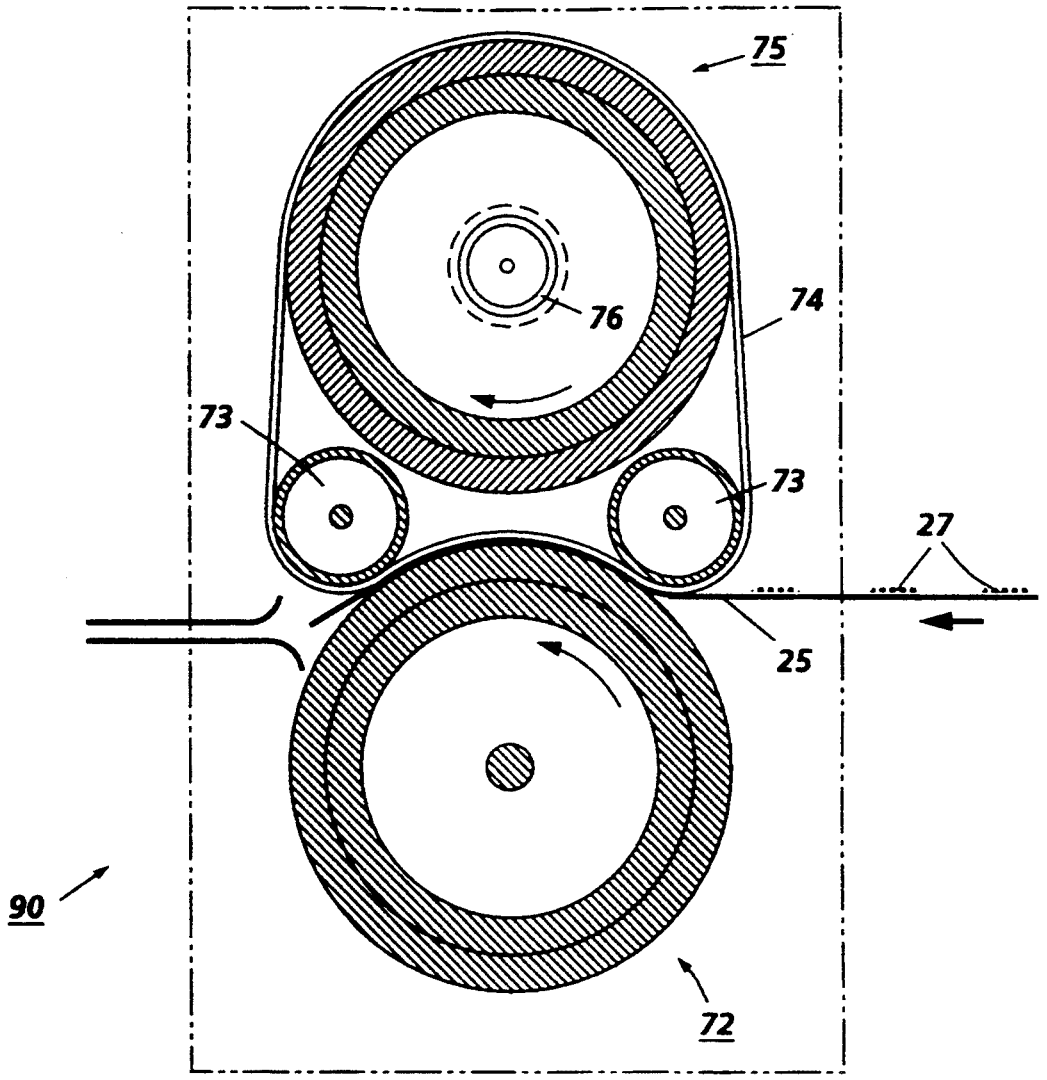
FIG. 3 is a side elevational view of a third embodiment of a heat and pressure contact fuser incorporating a thick walled internally heated belt of the present invention.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document and or to provide undercolor removal in a color image. Each of the developer units is moved into and out of an operative position. In the operative position, the magnetic brush is closely adjacent the photoconductive belt, while in the non-operative position, the magnetic brush is spaced therefrom. In FIG. 3, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes, securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 90, where the transferred toner image is permanently fused to the sheet. The fusing station includes an externally heated fuser belt 74 and a pressure roll 72. The sheet 25 passes through the nip defined by fuser belt 74 and pressure roll 72. The toner image 27 contacts fuser belt 74 so as to be affixed to the sheet 25. The operation and structure of fusing station 90 will be described in further detail with reference to FIG. 1. Thereafter, the sheet 25 is advanced to catch tray 88 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 1:
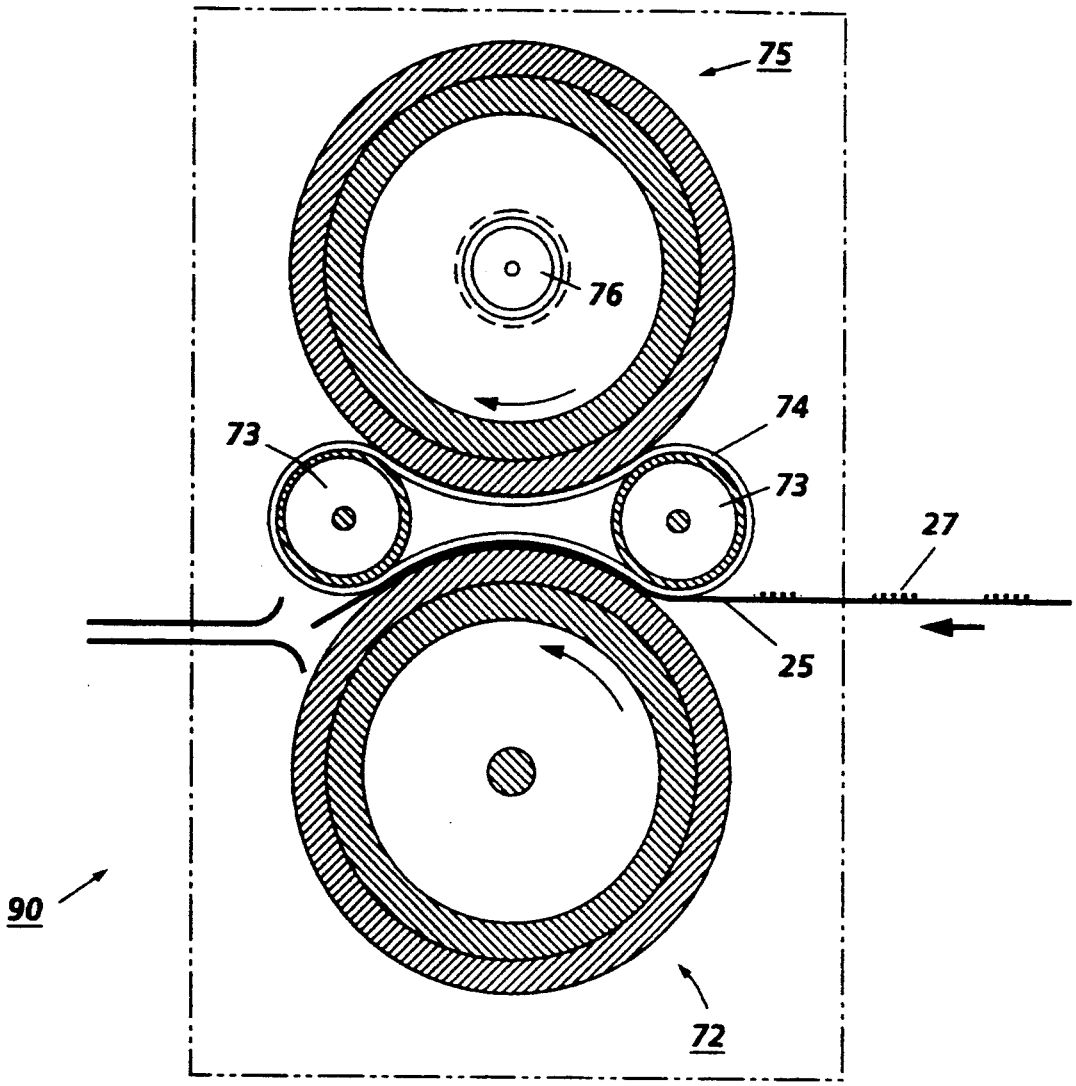
FIG. 1 is a side elevational view of a heat and pressure contact fuser incorporating the thick walled externally heated belt of the present invention.

Attention is now directed to FIG. 1, wherein the heat and pressure fuser apparatus 90 of the present invention is illustrated. As shown in FIG. 1, the fuser apparatus 90 is made up of a heater roll 75, a thick walled fusing belt 74 supported by rollers 73 and a pressure roll 72. The configuration illustrated allows the belt 74 to be wrapped around a relatively large portion of the heater roll 75 to effect a good heat transfer without necessitating extraordinarily high heating temperatures. The wrap allows a longer dwell time thereby heating the belt 74 in a more uniform manner. Preferably the external heating roll 75 is constructed out of aluminum with an internal quartz lamp heating element 76 as is disclosed in FIG. 1. Of course other known heating elements such as a quartz lamp or other radiant heat devices (provided the paper path is shielded from the heat source so as to prevent scorching of a jammed sheet) and roll materials could also be utilized.

The belt 74 is also wrapped over a greater portion of the pressure roll 72 to create a larger fusing nip than is possible in a conventional fuser roll system. It is this extended fusing nip that results in a longer fusing dwell time and thus allows faster fusing speeds. As discussed previously, especially in the case of multi-layer, full color toner images, it is the fuser dwell time which is a limiting speed factor. As the belt 74 of the present invention has a thick wall (being, for example, in the range of 0.0625–0.250 inches thick as compared to the 10–20 mils of conventional thin-walled belts), it may be reinforced with steel, glass and/or graphite fibers to provide high strength without impacting of the final image quality. This is in contrast to a thin reinforced belt which would cause the pattern of the reinforcing fibers to be transferred to the toner image. Such is not the case with the thick walled belt as proposed herein.

The thick wall configuration also allows the proper pressure to be exerted on the toner image without the need for back-up rolls or other localized pressure exerting devices. As illustrated, the belt 74 is supported by rollers 73 which creates two substantially horizontal spans. By placing the heater roll 75 against the belt 74 along one of the spans and locating the pressure roll 72 against the belt 74 along the other span, extended nips for both heating the belt 74 and fusing a copy sheet are created.

Figure 2:
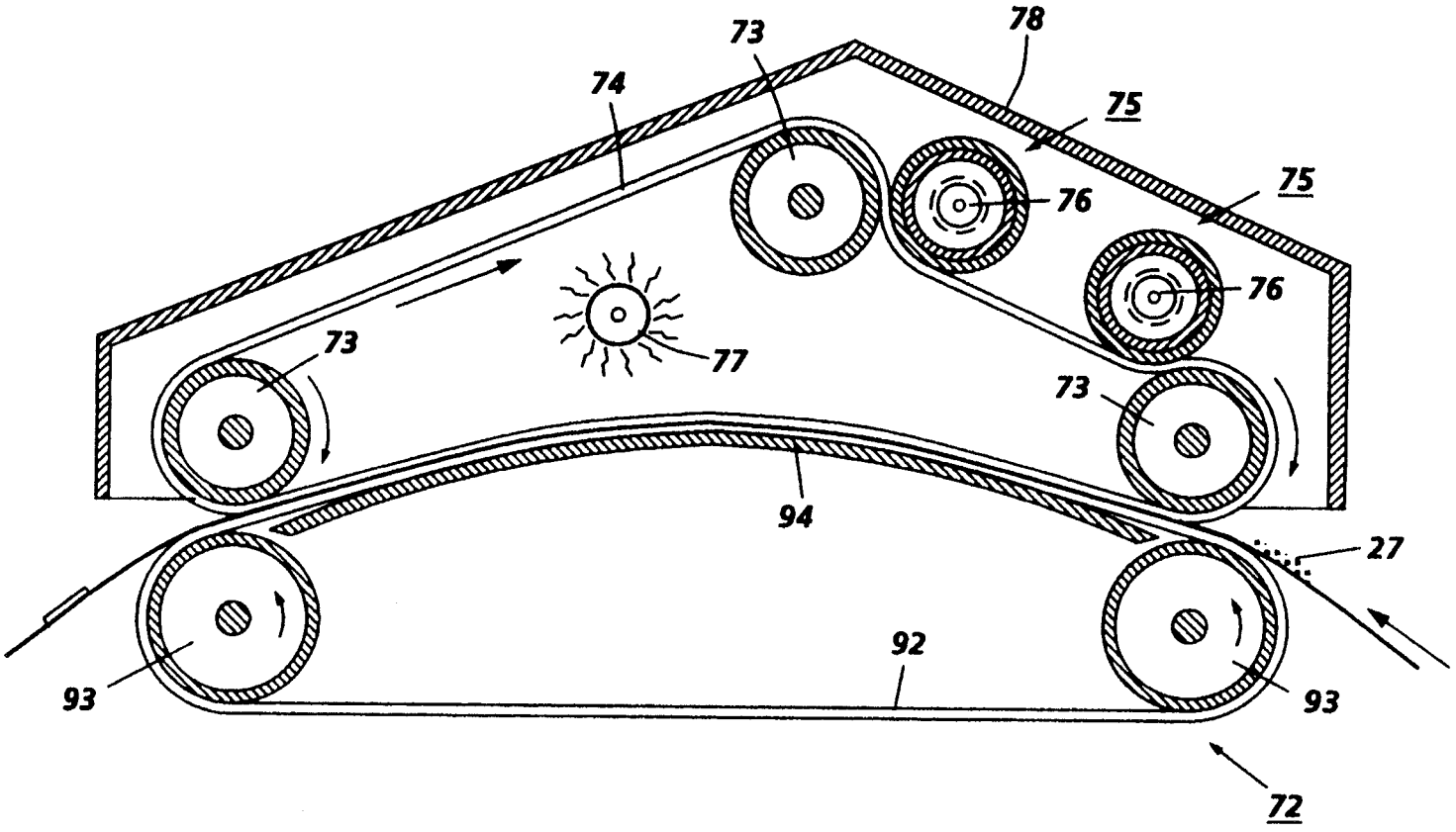
FIG. 2 is a side elevational view of a second embodiment of a heat and pressure contact fuser incorporating a thick walled externally heated belt and a standby heater.

FIG. 2 illustrates a second embodiment utilizing an externally heated fusing belt 74 which is supported by three rollers 73 and is wrapped around two heated rolls 76. A standby heat lamp 77 is provided internal to the belt 74 and along with a heat cover 78 helps to maintain heat in the fusing belt between copies and/or copy jobs. The pressure member 72 is a belt 92 supported by a pair of rollers 93 and having a backup manndral 94 in the fusing zone. This configuration provides a flatter fusing nip which can reduce the amount of curl in the finished sheet.

FIG. 3 illustrates a third embodiment utilizing an internally heated fusing belt 74. The FIG. 3 configuration allows a very extended heating wrap around heater roll 75 but the trade-off is that the belt must be constructed of a thermally conductive, yet flexible material, perhaps some sort of metallic mesh with an elastomeric layer thereon. Such an arrangement may allow heat to be retained within the inner space defined by the belt 74 if the ends were insulated so as to conserve heat energy while requiring a lesser temperature gradient.

In recapitulation, there is provided an externally heated thick walled belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the heat transfer. The second span of the belt forms an extended fusing nip with a pressure roll. The extended nip provides a greater dwell time for a sheet in the nip while allowing the fuser to operate at a greater speed. The thick profile of the belt allows the belt to be reinforced so as to operate at greater fusing pressures without degradation of the image. The thick profile and external heating of the belt also provides a much more robust design than conventional thin walled belt fusing systems.

It is, therefore, apparent that there has been provided in accordance with the present invention, an externally heated thick walled belt fuser that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A heat and pressure fuser apparatus comprising:

a rotatably supported fuser belt;

a pressure member adjacent a first portion of said belt wherein the first portion of said belt contacts said pressure member to form an extended nip therewith, said pressure member comprising a first rotatably supported roll in circumferential contact with said belt; and a heat source, adjacent a second portion of said belt said heat source comprises a second rotatably mounted roll in circumferential contact with the external surface of said belt and a heat generator, internal to said second roll, wherein said heat generator causes the temperature of the exterior surface of said second roll to elevate.

2. An apparatus according to claim 1, wherein said second rotatably mounted roll comprises a hollow aluminum cylinder supported at each end by rotatable bearings.

3. An apparatus as described in claim 1, wherein said belt has a relatively thick wall thickness.

4. A heat and pressure fuser apparatus comprising:

a rotatably supported fuser belt;

a pressure member adjacent a first portion of said belt wherein the first portion of said belt contacts said pressure member to form an extended nip therewith, said pressure member comprising a rotatably supported pressure belt and a backup member supporting said pressure belt in the region of the extended nip; and a heat source, adjacent a second portion of said belt, wherein said heat source comprises a rotatably mounted roll in circumferential contact with the external surface of said belt and a heat generator, internal to said roll, wherein said heat generator causes the temperature of the exterior surface of said roll to elevate.

5. A heat and pressure fuser apparatus comprising:

a rotatably supported fuser belt, said belt is supported on a pair of spaced rolls, with the first portion of said belt spanning the space between said pair of rolls and the second portion of said belt spanning the space between said pair of rolls so that the first portion of said belt and the second portion of said belt are opposed from one another;

a pressure member adjacent a first portion of said belt wherein the first portion of said belt contacts said pressure member to form an extended nip therewith, said pressure member comprising a first rotatably supported roll in circumferential contact with said belt; and a heat source, adjacent a second portion of said belt, said heat source comprises a second rotatably mounted roll in circumferential contact with the external surface of said belt and a heat generator, internal to said second roll, wherein said heat generator causes the temperature of the exterior surface of said second roll to elevate.

6. A heat and pressure fuser apparatus comprising:

a rotatably supported fuser belt, said belt comprising metal fibers enabling a high fusing pressure to be exerted on a sheet moved through an extended nip;

a pressure member adjacent a first portion of said belt wherein the first portion of said belt contacts said pressure member to form the extended nip therewith; and a heat source, adjacent a second portion of said belt.

7. A heat and pressure fuser apparatus comprising:

a rotatably supported fuser belt, said belt comprising glass fibers enabling a high fusing pressure to be exerted on a sheet moved through an extended nip;

a pressure member adjacent a first portion of said belt wherein the first portion of said belt contacts said pressure member to form the extended nip therewith; and a heat source, adjacent a second portion of said belt.

8. A heat and pressure fuser apparatus comprising:

a rotatably supported fuser belt, said belt comprising graphite fibers enabling a high fusing pressure to be exerted on a sheet moved through an extended nip;

a pressure member adjacent a first portion of said belt wherein the first portion of said belt contacts said pressure member to form the extended nip therewith; and a heat source, adjacent a second portion of said belt.

9. A heat and pressure fuser apparatus comprising:

a rotatably supported fuser belt;

a pressure member adjacent a first portion of said belt wherein the first portion of said belt contacts said pressure member to form an extended nip therewith; and a heat source adjacent a second portion of said belt, said heat source comprising a rotatably mounted roll in circumferential contact with the internal surface of said belt and a heat generator, internal to said second roll, wherein said heat generator causes the temperature of the exterior surface of said second roll to elevate.

10. An electrophotographic printing machine in which a toner image is heat and pressure fused to a substrate by a fuser member, wherein the improvement comprises:

a rotatably supported fuser belt;

a pressure member adjacent a first portion of said belt wherein the first portion of said belt contacts said pressure member to form an extended nip therewith, said pressure member comprising a first rotatably supported roll in circumferential contact with said belt; and a heat source, adjacent a second portion of said belt said heat source comprises a second rotatably mounted roll in circumferential contact with said belt and a heat generator, internal to said second roll, wherein said heat generator causes the temperature of the exterior surface of said second roll to elevate.

11. The printing machine of claim 10, wherein said belt is supported on a pair of spaced rolls, with the first portion of said belt spanning the space between said pair of rolls and the second portion of said belt spanning the space between said pair of rolls so that the first portion of said belt and the second portion of said belt are opposed from one another.

12. The printing machine of claim 10, wherein said belt has a relatively thick wall thickness.

13. The printing machine of claim 10, wherein said second rotatably mounted roll comprises a hollow aluminum cylinder supported at each end by rotatable bearings.

14. An electrophotographic printing machine in which a toner image is heat and pressure fused to a substrate by a fuser member, wherein the improvement comprises:

a rotatably supported fuser belt;

a pressure member adjacent a first portion of said belt wherein the first portion of said belt contacts said pressure member to form an extended nip therewith, said pressure member comprising a rotatably supported pressure belt and a backup member supporting said pressure belt in the region of the extended nip; and a heat source, adjacent a second portion of said belt, wherein said heat source comprises a second rotatably mounted roll in circumferential contact with said belt and a heat generator, internal to said second roll, wherein said heat generator causes the temperature of the exterior surface of said second roll to elevate.

15. An electrophotographic printing machine in which a toner image is heat and pressure fused to a substrate by a fuser member, wherein the improvement comprises:

a rotatably supported fuser belt, said belt comprises metal fibers enabling a high fusing pressure to be exerted on a sheet moved through an extended nip;

a pressure member adjacent a first portion of said belt wherein the first portion of said belt contacts said pressure member to form the extended nip therewith; and a heat source, adjacent a second portion of said belt.

16. An electrophotographic printing machine in which a toner image is heat and pressure fused to a substrate by a fuser member, wherein the improvement comprises:

a rotatably supported fuser belt, said belt comprises glass fibers enabling a high fusing pressure to be exerted on a sheet moved through an extended nip;

a pressure member adjacent a first portion of said belt wherein the first portion of said belt contacts said pressure member to form the extended nip therewith; and a heat source, adjacent a second portion of said belt.

17. An electrophotographic printing machine in which a toner image is heat and pressure fused to a substrate by a fuser member, wherein the improvement comprises:

a rotatably supported fuser belt, said belt comprises graphite fibers enabling a high fusing pressure to be exerted on a sheet moved through an extended nip;

a pressure member adjacent a first portion of said belt wherein the first portion of said belt contacts said pressure member to form the extended nip therewith; and a heat source, adjacent a second portion of said belt.

18. An electrophotographic printing machine in which a toner image is heat and pressure fused to a substrate by a fuser member, wherein the improvement comprises:

a rotatable supported fuser belt;

a pressure member adjacent a first portion of said belt wherein the first portion of said belt contacts said pressure member to form an extended nip therewith; and a heat source, adjacent a second portion of said belt, said heat source comprises a rotatably mounted roll in circumferential contact with the internal surface of said belt and a heat generator, internal to said second roll, wherein said heat generator causes the temperature of the exterior surface of said second roll to elevate.

* * * * *